US007265681B2

(12) United States Patent
Chen

(10) Patent No.: US 7,265,681 B2
(45) Date of Patent: Sep. 4, 2007

(54) LIGHT EMITTED DIODE DRIVING APPARATUS

(75) Inventor: Sheng-Feng Chen, Taipei Shien (TW)

(73) Assignee: Quanta Computer Inc., Tao Yuan Shien (TW)

( * ) Notice: Subject to any disclaimer, the term of this patent is extended or adjusted under 35 U.S.C. 154(b) by 290 days.

(21) Appl. No.: 11/139,527

(22) Filed: May 31, 2005

(65) Prior Publication Data

US 2006/0108933 A1 May 25, 2006

(30) Foreign Application Priority Data

Nov. 19, 2004 (TW) ..... 93135770 A

(51) Int. Cl.
*G08B 5/22* (2006.01)

(52) U.S. Cl. ..... 340/815.45; 340/340; 340/815.53; 340/815.62; 315/291; 315/397; 315/311; 345/83; 345/84; 345/55

(58) Field of Classification Search ..... 340/815.45, 340/815.53, 815.55, 815.62; 315/291, 307, 315/311, 312; 362/800; 345/84, 82, 83, 345/55, 30

See application file for complete search history.

(56) References Cited

U.S. PATENT DOCUMENTS 6,422,723 B1 * 7/2002 Walters ..... 362/471
6,466,188 B1 * 10/2002 Cato ..... 345/82
6,791,283 B2 * 9/2004 Bowman et al. ..... 315/291

* cited by examiner

*Primary Examiner*—Benjamin C. Lee
*Assistant Examiner*—Daniel Previl
(74) *Attorney, Agent, or Firm*—Rabin & Berdo, P.C.

(57) ABSTRACT

A driving apparatus includes a DC-to-DC converter, a first LED series, a second LED series, a first constant-current circuit, a second constant-current circuit, and a feedback circuit. The DC-to-DC converter respectively outputs a direct-current voltage to one terminal of the first and the second LED series to generate a first potential and a second potential at the other terminal of the first and the second LED series according to a feedback voltage. The first and the second constant-current circuits are respectively coupled to the other terminal of the first and the second LED series and output a first current and a second current for driving the first and the second LED series according to a first and a second control signals. The feedback circuit uses the lower one of the first potential and the second potential as a feedback voltage.

10 Claims, 2 Drawing Sheets

LIGHT EMITTED DIODE DRIVING APPARATUS

This application claims the benefit of Taiwan application Serial No. 93135770, filed Nov. 19, 2004, the subject matter of which is incorporated herein by reference.

BACKGROUND OF THE INVENTION

1. Field of the Invention

The invention relates in general to a light emitted diode driving apparatus, and more particularly to a light emitted diode driving apparatus having a constant-current circuit.

2. Description of the Related Art

A liquid crystal display uses a backlight module as a light source for a liquid crystal panel. The light source can be light emitted diodes (LEDs). The LED radiates light as a current flows by, and the LED luminance is directly proportional to the amount of the flowing current.

In order to provide the required LCD luminance, the backlight module has to use several LEDs for generating enough luminance. Referring to FIG. 1, a block diagram of a conventional LED driving apparatus is shown. In FIG. 1, A DC-to-DC converter 102 outputs a direct-current voltage DC to drive two LED series S1 and S2 and receives a feedback voltage Vf from the LED series S1. The DC-to-DC converter 102 adjusts the amount of voltage DC according to the feedback voltage Vf so that the LED series S1 and S2 can generate the required luminance.

However, each LED has a different cut-in voltage, so the currents Ia and Ib respectively flowing through the LED series S1 and S2 connected in parallel are different. As a result, LED series S1 and S2 have different luminance and thus the whole backlight module generates luminance of non-uniformity. Moreover, due to variation of each LED's cut-in voltage, each of the LED series S1 and S2 has a different voltage drop as in a turn-on state. Consequently, the DC-to-DC converter 102 cannot precisely control the LED series S1 and S2 to generate the same luminance according to the feedback voltage Vf.

Therefore, how to control the LED series to generate uniform luminance is a vital subject for a LED designer or manufacturer.

SUMMARY OF THE INVENTION

It is therefore an object of the invention to provide a LED driving apparatus. Each of the LED series is driven by an individual constant-current circuit so that each LED series can have the same flowing current to generate the same luminance.

The invention achieves the above-identified object by providing a LED driving apparatus. The driving apparatus includes a DC-to-DC converter, a first LED series, a second LED series, a first constant-current circuit, a second constant-current circuit, and a feedback circuit. The DC-to-DC converter has a feedback terminal and an output terminal. The DC-to-DC converter receives a feedback voltage at the feedback terminal and outputs a direct-current voltage at the output terminal. The first LED series has a first terminal and a second terminal. The first LED series receives the direct-current voltage at the first terminal and generates a first potential at the second terminal. The second LED series has a third terminal and a fourth terminal. The second LED series receives the direct-current voltage at the third terminal and generates a second potential at the fourth terminal. The first constant-current circuit is connected to the first LED series in series at the second terminal. The first constant-current circuit outputs a first current for driving the first LED series according to a first control signal. The second constant-current circuit is connected to the second LED series in series at the fourth terminal. The second constant-current circuit outputs a second current for driving the second LED series according to a second control signal. The feedback circuit is for selecting the lower one of the first potential and the second potential as the feedback voltage. The feedback circuit includes a first diode, a second diode, and a resistance. The first diode has a positive end electrically coupled to the feedback terminal and a negative end electrically coupled to the second terminal. The second diode has a positive end electrically coupled to the feedback terminal and a negative end electrically coupled to the fourth terminal. The resistance has one end electrically coupled to the feedback terminal and the other end for receiving a reference voltage.

The invention achieves the above-identified object by providing a LED driving apparatus for driving N LED series. N is a positive integer. Each of the N LED series has a LED input terminal and a LED output terminal. The LED driving apparatus includes a DC-to-DC converter, N constant-current circuits, and a feedback circuit. The DC-to-DC converter has a feedback terminal and an output terminal. The DC-to-DC converter outputs a direct-current voltage at the output terminal to generate N potentials at the N LED input terminals according to a feedback voltage received at the feedback terminal. N constant-current circuits are respectively connected to the N LED series in series at the N LED output terminal. The N constant-current circuits respectively output N current for driving the corresponding N LED series according to N control signals. The feedback circuit is for selecting the lower one of the N potentials and the second potential as the feedback voltage. The feedback circuit includes N diodes and a resistance. Each of the N diodes has a positive end electrically coupled to the feedback terminal and a negative end electrically coupled to the corresponding LED output terminal. The resistance has one end electrically coupled to the feedback terminal and the other end for receiving a reference voltage.

Other objects, features, and advantages of the invention will become apparent from the following detailed description of the preferred but non-limiting embodiments. The following description is made with reference to the accompanying drawings.

DETAILED DESCRIPTION OF THE INVENTION

The object of the invention is to have each LED series able to generate the same luminance, that is, have equal current flowing through each LED series. According to the invention, each LED series is driven by an individual constant-current circuit. For example, the first LED series is driven by a first constant-current circuit while the second LED series driven by a second constant-current circuit. By controlling the current output by the first and the second constant-current circuits to be equal, each LED series can have the same current flowing by.

Figure 1:
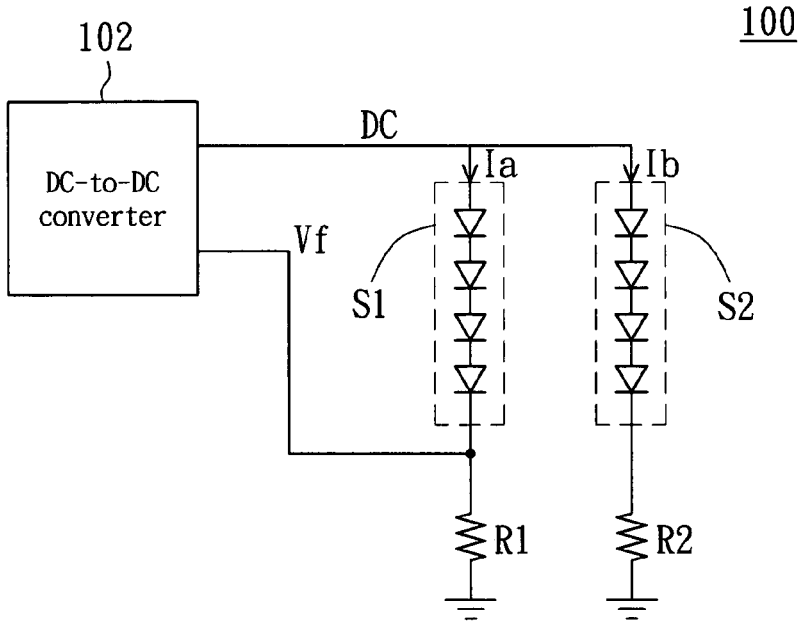
FIG. 1(PRIOR ART)
FIG. 1 (Prior Art) is a block diagram of a conventional LED driving apparatus.
Figure 2:
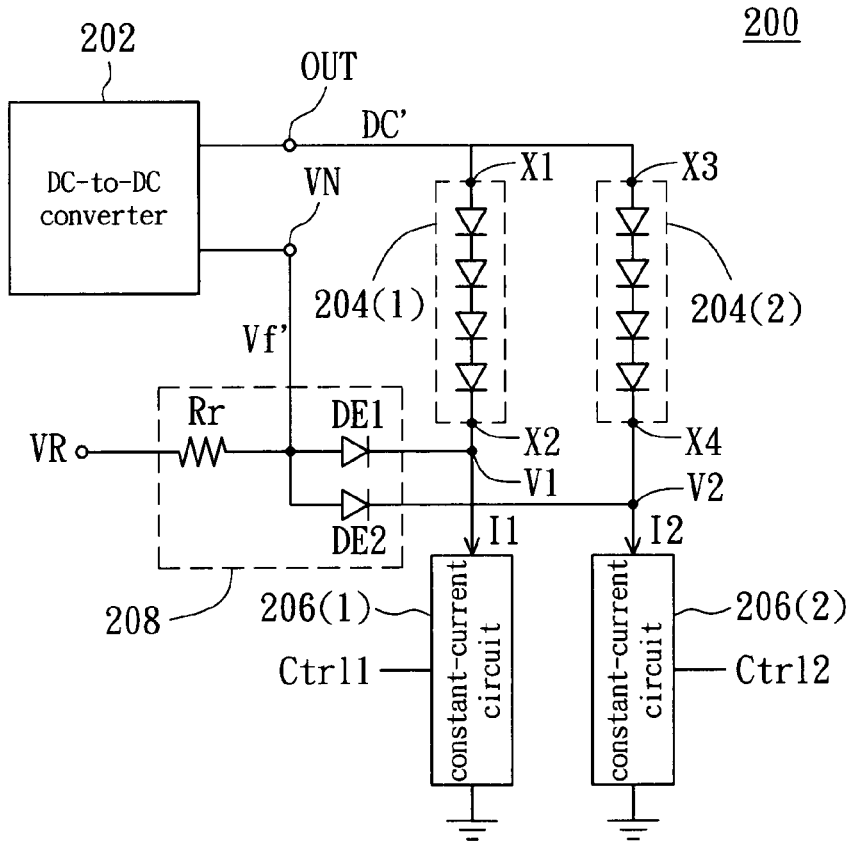
FIG. 2 is a circuit diagram of a LED driving apparatus according to a preferred embodiment of the invention.

Referring to FIG. 2, a circuit diagram of a LED driving apparatus according to a preferred embodiment of the invention is shown. The LED driving apparatus 200 includes a DC-to-DC converter 202, N LED series 204, N constant-current circuits 206, and N feedback circuits 208, wherein N is a positive integer. Each of the N LED series has a LED input terminal (X1, X3) and a LED output terminal (X2, X4). Two LED series (N=2) are taken as an example in the embodiment. The two LED series are respectively a first LED series 204(1), and a second LED series 204(2). In response to the two LED series 204(1) and 204(2), two constant-current circuits are respectively a first constant-current circuit 206(1) and a second constant-current circuit 206(2). The DC-to-DC converter 202, for outputting a direct-current voltage DC', has a feedback terminal VN and an output terminal OUT. The first LED series 204(1) has a first terminal X1 and a second terminal X2 while the second LED series has a third terminal X3 and a fourth terminal X4. The first terminal X1 and the third terminal X3 are LED input terminals while the second terminal X2 and the fourth terminal X4 are LED output terminals. The first LED series 204(1) receives the voltage DC' at the first terminal X1, and generates a first electric potential V1 at the second terminal X2. The second LED series 204(2) receives the voltage DC' at the third terminal X3 and generates a second electric potential V2 at the fourth terminal X4.

The first constant-current circuit 206(1) is connected in series with the first LED series 204(1) at the second terminal X2. The first constant-current circuit 206(1) outputs a first current I1 for driving the first LED series 204(1) according to a first control signal Ctrl 1. The second constant-current circuit 206(2) is connected in series with the second LED series 204(2) at the fourth terminal X4. The second constant-current circuit 206(2) outputs a second current 12 for driving the second LED series 204(2) according to a second control signal Ctrl 2.

The feedback circuit 208 selects the lower one of the first potential V1 and the second potential V2 to be a feedback voltage Vf'. The feedback circuit 208 includes a first diode DE1, a second diode DE2 and a resistor Rr. The first diode DE1 has a positive end electrically coupled to the feedback terminal VN and a negative end electrically coupled to the second terminal X2. The second diode DE2 has a positive end electrically coupled to the feedback terminal VN and a negative end electrically coupled to the fourth terminal X4. The resistor Rr has one end electrically coupled to the feedback terminal VN and the other end for receiving a reference voltage VR.

Figure 3A:
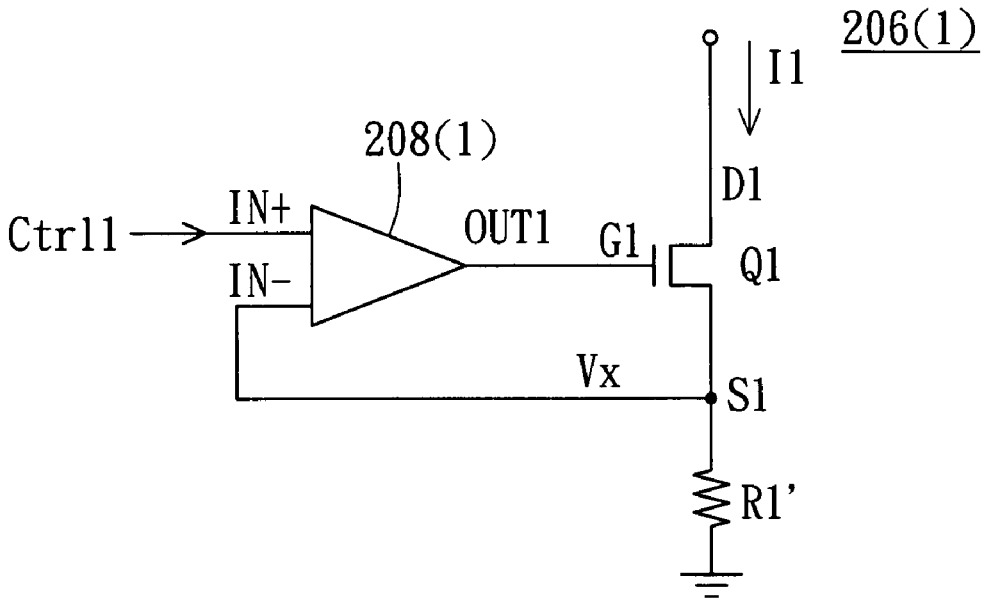
FIG. 3A is a circuit diagram of the first constant-current circuit in FIG. 2.

Referring to FIG. 3A, a circuit diagram of the first constant-current circuit 206(1) in FIG. 2 is shown. The first constant-current circuit 206(1) includes a first operational amplifier 208(1), a first transistor Q1, and a first resistor R1'. The first transistor Q1, such as a NMOS, has a first transistor terminal D1 as a drain, a second transistor terminal S1 as a source, and a first transistor control terminal G1 as a gate. The first operational amplifier 208(1) has a first positive input terminal IN+, a first negative input terminal IN−, and an operational amplifier output terminal OUT1. The first positive input terminal IN+ of the operational amplifier 208(1) receives the first control signal Ctr1 1 while the first negative input terminal IN− and the source S1 of the first transistor Q1 are coupled to a constant voltage, such as a ground voltage, via the first resistor R1'. The gate G1 of the transistor Q1 is electrically coupled to the operational amplifier output terminal OUT1. The first constant-current circuit 206(1) adjusts its output first current I1 to change luminance of the first LED series 204(1) according to the voltage of the first control signal Ctrl 1.

Figure 3B:
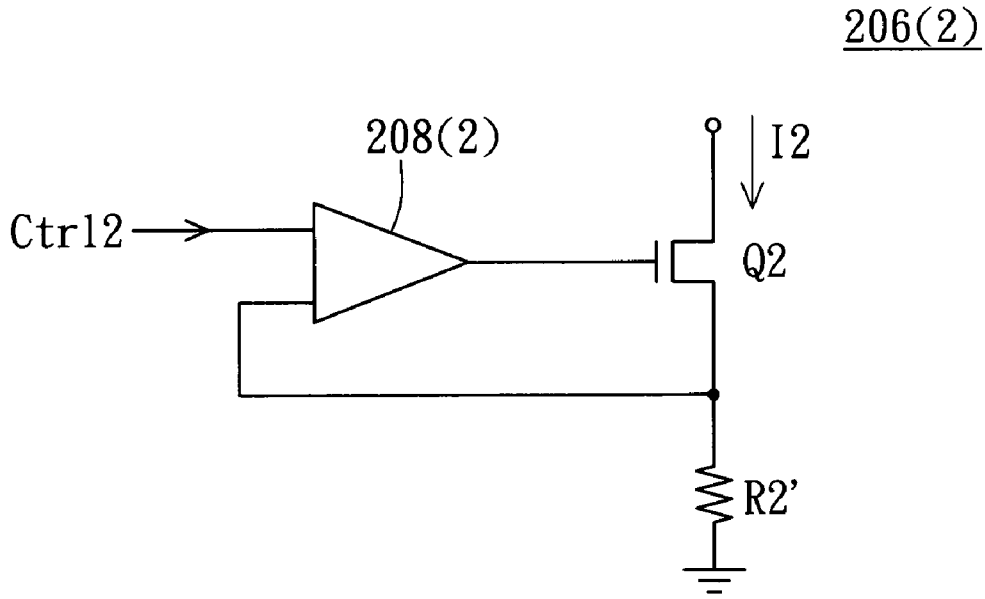
FIG. 3B is a circuit diagram of the second constant-current circuit in FIG. 2.

Referring to FIG. 3B, a circuit diagram of the second constant-current circuit 206(2) in FIG. 2 is shown. The second constant-current circuit 206(2), having the same structure as the first constant-current circuit 206(1) includes a second transistor Q2, a second operational amplifier 208 (2), and a second resistor R2'. Therefore, any detail of the second constant-current circuit 206(2) is the same with the first constant-current circuit 206(1) not necessary described here.

The first and the second LED series 204(1) and 204(2) respectively generate the same luminance according to constant currents i.e. the first and the second current I1 and I2 generated by the first and the second constant-current circuits 206(1) and 206(2).

The first and the second currents I1 and I2 can be adjusted to change the luminance of the first and the second LED series 204(1) and 204(2) according to the voltage of control signals Ctrl 1 and Ctrl 2. For example, the voltage Vx can be adjusted by changing the voltage of first control signal Ctrl 1. Then the first current I1, which is equal to Vx/R1', is also changed in order to achieve the purpose of adjusting the first LED series 204(1). There are many methods for adjusting voltage of the control signals Ctrl 1 and Ctrl 2. For example, the control signals Ctrl 1 and Ctrl 2 are adjustable voltages and the luminance of the LED series 204(1) and 204(2) can be adjusted by changing control signals' voltages.

The control signals Ctrl 1 and Ctrl 2 can also be a pulse width modulation (PWM) signal. By changing their duty cycles, the current average values of the first and the second currents I1 and I2 can be changed so as to adjust the luminance of the LED series 204(1) and 204(2). In addition, except that the two control signals Ctrl 1 and Ctrl 2 have the same potential, the control signals Ctrl 1 and Ctrl 2 can have a phase difference in accordance with the number of LED series. With regard to two LED series, For example, the control signals Ctrl 1 and Ctrl 2 can have a phase difference of 180 degrees. If there are N LED series 204, there will also be N constant-current circuits 206 and N control signals Ctrl, while phases of N control signals differ from each other by 360/N degrees. Similarly, voltages of the control signals Ctrl can be adjusted by changing the pulse width of control signals. N control signals have phases differing from each other by 360/N degrees, so the DC-to-DC converter 202 can output a uniform current.

Furthermore, in terms of feedback, the feedback circuit 208 has two LEDs (DE1 and DE2) in response to the LED series 204(1) and 204(2). The LEDs (DE1 and DE2) are used to select the lower one of the first potential V1 at the second terminal X2 and the second potential V2 at the fourth terminal X4 as the feedback voltage Vf'. That is, when the voltage drop VRF1 of the first LED series 204(1) is larger than the voltage drop VRF2 of the second LED series 204(2), the first potential V1 at the second terminal X2 will be lower than the second potential V2 at the fourth terminal X4, and thus the first voltage V1 will be selected as the feedback voltage Vf'. If the feedback voltage Vf' is lower than the internal reference voltage of the DC-to-DC converter 202, the DC-to-DC converter 202 will lift the output voltage DC to increase the first potential V1 until the feedback voltage Vf' is equal to the internal reference voltage. With regard to the second LED series 204(2) and the constant-current circuit 206(2), when the first voltage V1 increases, the voltage increase will enlarge voltage drop between the drain and the source of the transistor Q1 in the constant-current circuit 206(1), but will not influence the second current I2 output by the constant-current circuit 206(2).

Except for feedback function, the feedback circuit 208 can also be used to ensure that the first and the second constant-current circuits 206(1) and 206(2) can output a constant current.

The LED driving apparatus disclosed by the above-mentioned embodiment of the invention can control each LED series to generate the same luminance by using an individual constant-current circuit to drive each LED series. By adjusting the control signal voltage, the constant-current circuit can output a various current to change each LED series' luminance. Selecting the lowest one of output terminal potentials of the LED series as the feedback voltage by using a feedback circuit, each LED series can have enough voltage to turn on its LEDs.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A light emitted diode (LED) driving apparatus, comprising:

a DC-to-DC converter, having a feedback terminal and an output terminal, wherein the DC-to-DC converter receives a feedback voltage at the feedback terminal and outputs a direct-current voltage at the output terminal;

a first LED series, having a first terminal and a second terminal, wherein the first LED series receives the direct-current voltage at the first terminal and generates a first potential at the second terminal;

a second LED series, having a third terminal and a fourth terminal, wherein the second LED series receives the direct-current voltage at the third terminal and generates a second potential at the fourth terminal;

a first constant-current circuit, connected to the first LED series in series at the second terminal, wherein the first constant-current circuit outputs a first current for driving the first LED series according to a first control signal;

a second constant-current circuit, connected to the second LED series in series at the fourth terminal, wherein the second constant-current circuit outputs a second current for driving the second LED series according to a second control signal; and a feedback circuit, for selecting the lower one of the first potential and the second potential as the feedback voltage, the feedback circuit comprising:

a first diode, having a positive end electrically coupled to the feedback terminal and a negative end electrically coupled to the second terminal;

a second diode, having a positive end electrically coupled to the feedback terminal and a negative end electrically coupled to the fourth terminal; and a resistance, having one end electrically coupled to the feedback terminal and the other end for receiving a reference voltage.

2. The driving apparatus according to claim 1, wherein the first constant-current circuit comprises:

a first resistor;

a first transistor, having a first transistor terminal, a second transistor terminal, and a first transistor control terminal, wherein the first transistor terminal is electrically coupled to the second terminal, and the second transistor terminal is coupled to a constant voltage via the first resistor; and a first operational amplifier, having a first positive input terminal, a first negative input terminal, and a first operational amplifier output terminal, wherein the first positive input terminal receives the first control signal, the first negative input terminal is electrically coupled to the second transistor terminal, and the first operational amplifier output terminal is electrically coupled to the first transistor control terminal.

3. The driving apparatus according to claim 2, wherein the second constant-current circuit comprises:

a second resistor;

a second transistor, having a third transistor terminal, a fourth transistor terminal, and a second transistor control terminal, wherein the third transistor terminal is electrically coupled to the fourth terminal, and the fourth transistor terminal is coupled to a constant voltage via the second resistor; and a second operational amplifier, having a second positive input terminal, a second negative input terminal, and a second operational amplifier output terminal, wherein the second positive input terminal receives the second control signal, the second negative input terminal is electrically coupled to the fourth transistor terminal, and the second operational amplifier output terminal is electrically coupled to the second transistor control terminal.

4. The driving apparatus according to claim 3, wherein voltages of the first control signal and the second control signal are adjustable, and luminance of the first LED series and the second LED series is adjusted by changing the voltages of the first control signal and the second control signal.

5. The driving apparatus according to claim 3, wherein the first control signal and the second control signal are pulse width modulation (PWM) signals, and luminance of the first LED series and the second LED series is adjusted by changing a duty cycle of the first control signal and the second control signal.

6. The driving apparatus according to claim 3, wherein the first control signal and the second control signal have a phase difference of 180 degrees.

7. A light emitted diode (LED) driving apparatus, for driving N LED series, N being a positive integer, each of the N LED series having a LED input terminal and a LED output terminal, the LED driving apparatus comprising:

a DC-to-DC converter, having a feedback terminal and an output terminal, wherein the DC-to-DC converter outputs a direct-current voltage at the output terminal to generate N potentials at the N LED input terminals according to a feedback voltage received at the feedback terminal;

N constant-current circuits, respectively connected to the N LED series in series at the N LED output terminal, wherein the N constant-current circuits respectively output N current for driving the corresponding N LED series according to N control signals;

a feedback circuit, for selecting the lower one of the N potentials and the second potential as the feedback voltage, the feedback circuit comprising:

N diodes, each having a positive end electrically coupled to the feedback terminal and a negative end electrically coupled to the corresponding LED output terminal; and a resistance, having one end electrically coupled to the feedback terminal and the other end for receiving a reference voltage.

8. The driving apparatus according to claim 7, wherein the N control signals are adjustable, and luminance of the N LED series is adjusted by changing the voltages of the corresponding N control signals.

9. The driving apparatus according to claim 7, wherein the N control signals are pulse width modulation (PWM) signals, and luminance of the N LED series is adjusted by changing duty cycles of the corresponding N control signals.

10. The driving apparatus according to claim 9, wherein the N control signals have phases differing from each other by 360/N degrees.

* * * * *